US005173577A

United States Patent [19]

Clegg et al.

[11] Patent Number: 5,173,577

[45] Date of Patent: Dec. 22, 1992

[54] STAMP FORMED MUFFLER WITH LOW BACK PRESSURE

[75] Inventors: Michael W. Clegg; Jon W. Harwood; Robert A. Kohntopp, all of Toledo, Ohio

[73] Assignee: AP Parts Manufacturing Co., Ohio

[21] Appl. No.: 577,495

[22] Filed: Sep. 4, 1990

[51] Int. Cl.[5] ..... F01N 7/18

[52] U.S. Cl. ..... 181/282; 181/269

[58] Field of Search ..... 181/282, 243, 228, 272

[56] References Cited

U.S. PATENT DOCUMENTS

| | | | |
|---|---|---|---|
| 705,357 | 7/1902 | Keating | 181/264 |
| 1,110,040 | 9/1914 | Chatain | 181/238 |
| 2,484,826 | 10/1949 | Harley | 181/49 |
| 2,484,827 | 10/1949 | Harley | 181/35 |
| 2,658,580 | 11/1953 | Trembley | 181/49 |
| 2,860,722 | 11/1958 | Gerstung | 181/68 |
| 2,902,109 | 9/1959 | Burgess et al. | 181/53 |
| 2,943,695 | 7/1960 | Jeffords | 181/50 |
| 3,125,182 | 3/1964 | Earley | 181/53 |
| 3,140,755 | 7/1964 | Tranel | 181/61 |
| 3,158,222 | 11/1964 | Richmond | 181/59 |
| 3,176,791 | 4/1965 | Betts et al. | 181/52 |
| 3,198,284 | 8/1965 | Powers | 181/54 |
| 3,220,508 | 11/1965 | Nordquest et al. | 181/61 |
| 3,412,825 | 11/1968 | Hall | 181/61 |
| 3,638,756 | 2/1972 | Thiele | 181/282 |
| 3,650,354 | 3/1972 | Gordon | 181/61 |
| 3,709,320 | 1/1973 | Höllerl et al. | 181/61 |
| 3,827,529 | 8/1974 | Frietzsche et al. | 181/238 |
| 3,852,041 | 12/1974 | Moore et al. | 181/288 F |
| 4,064,962 | 12/1977 | Hunt | 181/272 |
| 4,108,274 | 8/1978 | Snyder | 181/229 |
| 4,109,751 | 8/1978 | Kabele | 181/247 |
| 4,132,286 | 1/1979 | Hasui et al. | 181/265 |
| 4,165,798 | 8/1979 | Martinez | 181/265 |

(List continued on next page.)

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

OTHER PUBLICATIONS

NACA Report 1192, Theoretical and Experimental Investigation of Mufflers with Comments on Engine--Exhaust Muffler Design by Don D. Davis, Jr. et al., 1953.

*Primary Examiner*—Michael L. Gellner
*Assistant Examiner*—Eddie C. Lee
*Attorney, Agent, or Firm*—Anthony J. Casella; Gerald E. Hespos

[57] ABSTRACT

The subject invention is directed to a muffler formed from a plurality of stamped components. The stamped components include at least a pair of plates formed to define an array of tubes therein. The tubes include a plurality of unidirectional flow tubes each of which carries a portion of the exhaust gas flowing through the muffler. The plurality of unidirectional flow tubes communicate with an in-line expansion chamber defined within the muffler. The in-line expansion chamber enables exhaust gas flowing from the unidirectional flow tubes to expand significantly thereby contributing to noise attenuation. The muffler may further include at least one external shell defining a chamber which communicates with the tubes or the in-line expansion chamber.

29 Claims, 4 Drawing Sheets

U.S. PATENT DOCUMENTS

| | | | |
|---|---|---|---|
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Normura et al. | 181/219 |
| 4,456,091 | 6/1984 | Blanchot | 181/282 |
| 4,523,660 | 6/1985 | Gaddi | 181/228 |
| 4,598,790 | 7/1986 | Vesugi et al. | 181/252 |
| 4,690,245 | 9/1987 | Gregorich et al. | 181/272 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,809,812 | 3/1989 | Flugger | 181/268 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/157 R |
| 4,860,853 | 8/1989 | Moring, III | 181/282 |
| 4,894,987 | 1/1990 | Harwood et al. | 181/282 |
| 4,901,815 | 2/1990 | Harwood et al. | 181/282 |
| 4,901,816 | 2/1990 | Garey | 181/296 |
| 4,905,791 | 3/1990 | Garey | 181/282 |
| 4,909,348 | 3/1990 | Harwood et al. | 181/282 |
| 5,012,891 | 5/1991 | Macaluso | 181/282 |

STAMP FORMED MUFFLER WITH LOW BACK PRESSURE

BACKGROUND OF THE INVENTION

The exhaust system for an internal combustion engine includes a muffler to attenuate the noise associated with the flow of exhaust gas from the engine. Unfortunately, as explained further herein, mufflers necessarily impose a back pressure on the flow of the exhaust gas. Engine efficiency varies generally inversely with the level of back pressure in the exhaust system. Thus, higher back pressures reduce engine efficiency and fuel economy, while lower back pressures enable the engine to operate more efficiently.

Prior art mufflers having only a single straight-through tube, will provide low back pressure and therefore will have a minimal adverse effect on engine efficiency. Examples of these prior art mufflers are the "glasspacks" that are used by hot-rodders for optimum engine performance. A glasspack typically will include a single linear perforated or louvered tube disposed in a tubular outer shell and with a fiberglass noise insulation disposed between the perforated or louvered tube and the outer shell. Although prior art mufflers of this type may achieve a low back pressure, they are not effective in attenuating noise, and do not achieve the noise attenuation requirements for new automotive vehicles in the United States.

Exhaust mufflers on most new cars are very effective in attenuating noise, but create significant back pressure with a corresponding negative effect on engine performance and efficiency. A prior art muffler is illustrated in FIG. and is identified generally by the numeral 10. The muffler 10 comprises a plurality of separate tubes, 11–13 which are supported in a parallel array by transversely extending baffles 14 and 15. The baffles 14 and 15 typically are of oval or circular configuration corresponding to the selected cross-sectional size and shape for the muffler 10. Portions of the tubes 11–13 disposed between the baffles 14 and 15 may be perforated or louvered to permit a controlled expansion of exhaust gas from each tube 11–13, and to permit some communication therebetween. The tubes 11–13 and baffles 14 and 15 of the prior art muffler 10 are disposed within a tubular outer shell 16 of generally oval or circular cross-sectional configuration conforming to the shape of the baffles 14 and 15. End caps 17 and 18 ar mounted to the opposed ends of the outer shell 16 to substantially enclose the tubes 11–13. The end cap 17 is provided with an aperture to enable the exhaust pipe of the exhaust system to communicate with the tube 11. Similarly, the end cap 18 is provided with an aperture to enable the tube 13 to communicate with the tail pipe of an exhaust system. This typical prior art muffler 10 defines a total of three chambers 19, 20 and 21. With this prior art construction, exhaust gas from the engine will enter the tube 11. A controlled amount of expansion will occur in the perforated region of the tube 11 passing through the chamber 20. Most of the exhaust gas, however, will flow from the tube 11 and will abruptly expand into the chamber 21, then will undergo a 180° change of direction to enter the tube 12. The well defined edges of tubes 11 and 12 create turbulence and back pressure on the exhaust gas flowing therebetween. Once again, some expansion will occur as the exhaust gas in the tube 12 passes through the chamber 20. However, most exhaust gas will flow through the tube 12 and into the chamber 19. The exhaust gas will expand abruptly again and will undergo another 180° change of direction to enter the tube 13. The exhaust gas will then travel once again through the chamber 20 and toward the tail pipe connected to the tube 13. Turbulence and back pressure again will be created by the raw edges of the tubes 12 and 13. It will be appreciated that many more complex variations of this prior art muffler 10 exist, including mufflers having more than three pipes and more than two transverse baffles. Furthermore, the dimensions and locations of the components will vary in accordance with the needs of the system.

Although the prior art muffler 10 is very effective in attenuating noise, it suffers from several significant deficiencies. First, the abrupt expansion and the 180° changes in direction which take place in the chambers 21 and 19 respectively create significant back pressure with corresponding negative effects on engine efficiency. It is estimated that this prior art muffler 10 will reduce engine efficiency by 10%–30%, with the exact percentage being dependent on various parameters of the system, including how well the muffler is designed. Attempts have been made to enhance efficiency by providing concave reflecting surfaces in the chambers in which such changes of direction take place. However, these attempts do not significantly offset the eddying motion of exhaust gas which is responsible for a large loss of flow energy and a high pressure drop for the total system. The typical prior art muffler 10 also is undesirable in that it requires a large number of separate parts that must be assembled in a labor intensive manufacturing process. Additionally, the prior art muffler 10 affords few options in designing the muffler to fit the available space on the vehicle. In this regard, the prior art muffler 10 is substantially limited to a uniform circular or oval cross-sectional shape with an inlet at one end and outlet at the opposed end. To conform with these shape limitations the exhaust pipe and tailpipe often must undergo long sweeping turns which add significantly to the length of these pipes with corresponding increases in both cost and weight.

Mufflers formed at least in part from stamped components have been available for many years. The typical prior art stamp formed muffler has included a pair of opposed internal plates that are stamped to define a circuitous perforated tube therebetween. A pair of external shells are stamped to define at least one chamber surrounding the perforated tube. These prior art stamp formed mufflers are well suited to automated manufacturing techniques and therefore offer some manufacturing efficiencies over the above-described an illustrated conventional prior art muffler. Examples of prior art stamp formed mufflers of this general type are shown in British Patent No. 632,013 was issued to White in 1949; British Patent No. 1,012,463 was issued to Woolgar on Dec. 8, 1965; Japanese published Patent Application No. 59-43456 which was published in 1984; and U.S. Pat. No. 4,132,286 was issued to Hasui et al on Jan. 2, 1979. These mufflers may eliminate a broad range of the noise associated with the flow of exhaust gases. However, most mufflers that rely entirely on perforated tubes and expansion chambers fail to attenuate at least one fairly narrow range of low frequency noise associated with the flow of exhaust gases. Consequently, prior art mufflers of this type have been employed on lawnmowers and chainsaws where noise attenuation is less critical and on some European sports cars where a low frequency residual noise is acceptable and/or desirable. Mufflers of this general type have not been accepted on new cars in the United States where more stringent noise control is required.

The prior art further includes mufflers having a circuitous array of nonperforated tubes and chambers arranged in series for the exhaust gas to flow through. Examples of this type of prior art muffler include U.S. Pat. No. 3,176,791 was issued to Betts et al. on Apr. 6, 1965 and U.S. Pat. No. 3,638,756 was issued to Thiele on Feb. 1, 1972. One muffler depicted in U.S. Pat. No. 3,638,756 shows a single flow tube communicating with an in-line expansion chamber. These mufflers also have not been commercially accepted on automotive vehicles.

Still other prior art mufflers include conventional tubular components disposed within a stamped outer shell. Mufflers of this general type are shown in U.K. Patent Application No. 21 120 318 and U.S. Pat. No. 4,109,751 which issued to Kabele on Aug. 29, 1978. These prior art mufflers may offer some manufacturing efficiencies, but generally suffer from the back pressure problems of the conventional prior art muffler depicted on FIG. 1.

The recent prior art includes several very significant advances in stamped muffler technology. In particular, U.S. Pat. No. 4,700,806 issued to Jon Harwood on Oct. 20, 1987 and is assigned to the assignee of the subject application. The muffler in U.S. Pat. No. 4,700,806 is uniquely constructed from stamped components to provide at least one tuning tube, at least one low frequency resonating chamber communicating with the tuning tube, and at least one expansion chamber communicating with at least one other tube in the muffler. This unique combination enables the muffler shown in U.S. Pat. No. 4,700,806 to achieve noise attenuation that is at least equal to the attenuation enabled by the conventional prior art muffler depicted in FIG. 1 above. Additionally, the muffler in U.S. Pat. No. 4,700,806 achieves the various manufacturing efficiencies available with stamped technology, and has been found to provide significantly lower back pressure levels than the conventional muffler as depicted in FIG. 1. The lower back pressure levels are at least partly attributable to the smoothly curved tubes stamped into the internal plates to effect changes of direction for the exhaust gas traveling through the muffler. Furthermore, the cross-sectional dimensions of the tubes can be selectively changed along the flow path to optimize both noise attenuation and back pressure. The disclosure of U.S. Pat. No. 4,700,806 is incorporated herein by reference.

The assignee of the subject application has made several other significant advances in stamped muffler technology. For example, U.S. Pat. No. 4,760,894 shows the use of the stamp formed technology to provide a muffler having angularly aligned inlets and outlets to achieve and efficient routing of pipes to and from the muffler. U.S. Pat. No. 4,821,840 and U.S. Pat. No. 4,909,348 both show the use of stamped muffler technology to efficiently nest the muffler into the available shape on the vehicle. U.S. Pat. No. 4,765,437 shows stamp formed mufflers having plural low frequency resonating chambers and an expansion chamber with only a single baffle crease being formed in each external shell of the muffler. U.S. Pat. No. 4,836,330 shows a stamp formed muffler with an expansion chamber, a plurality of low frequency resonating chambers, and with only a single tube crossing the baffle crease to avoid creating pockets that conceivably could accumulate corrosive materials. Pending U.S. patent application Ser. No. 471,288 also is assigned to the assignee of the subject invention and shows a muffler with a transverse tube aligned with the baffle crease of the external shells to minimize the amount of deformation in the baffle crease and to avoid creating pockets. The disclosures of the above-referenced patents and the application that are assigned to the assignee of the subject invention are incorporated herein by reference.

Despite the many advantages of the stamp formed mufflers developed by the assignee of the subject invention, there is still the desire to further improve exhaust system technology. For example, new car manufacturers are subject to increasing pressure to enhance fuel efficiency and engine performance. One approach to enhancing fuel efficiency is to reduce the back pressure provided by the exhaust system. Although the above-described stamped muffler technology reduces back pressure over the conventional prior art muffler, it is desired to provide even further reductions in back pressure.

Fuel efficiency also can be improved by reducing vehicular weight. A muffler that requires less metal necessarily would be lighter and therefore could contribute proportionally to fuel efficiency. Lightweight mufflers require less material and therefore may cost less. In this regard, the automotive industry is very competitive, and even small savings in cost can be significant Many of the above-described prior art stamp formed mufflers that are assigned to the assignee of the subject invention are stamped to include a baffle crease that is unitary with the external shell and that separates chambers of the muffler. The unitary baffle crease has been found to be an extremely effective and efficient means for forming a plurality of chambers. An entirely separate baffle, on the other hand, would require different stamping dies and a more complex assembly process. However, both unitary baffle creases and separate baffles may add to the total amount of metal required for the muffler, thereby adding to costs and weight. For these reasons, a muffler that eliminates both separate baffles and unitary baffle creases could be desirable in some situations.

It is known that desirable sound attenuation can be achieved by directing the tube of a muffler into a comparatively very large chamber or "expansion can" which permits substantial expansion of the exhaust gas. Attenuation at any selected frequency generally increases with the ratio of the chamber's cross-sectional area to the inlet tube's cross-sectional area. However, the limited available space on the underside of a vehicle generally has prevented the use of a very large in-line expansion chamber into which an incoming tube may communicate. Conversely, the use of a very small inlet tube would create significant back pressure on the prior art muffler with the above-described negative effect o engine performance. A general discussion of in-line expansion chambers is provided in NACA Report 1192 "Theoretical and Experimental Investigation of Mufflers with Comments on Engine—Exhaust Muffler Design" by Don D. Davis Jr. et al. The mufflers shown in NACA Report 1192 all have conventional tubes with well defined edges leading into the in-line expansion chamber, and thus create turbulence and back pressure as explained above. As noted above, U.S. Pat. No. 3,638,756 shows an in-line expansion chamber in a muffler formed entirely from stamped components. However, space limitations and back pressure requirement would severely limit the range of expansion ratios that could be achieved with the muffler of U.S. Pat. No. 3,638,756.

Still another version of a prior art muffler is shown in U.S. Pat. No. 4,809,812 which issued to Flugger on Mar. 7, 1989. The muffler shown in U.S. Pat. No. 4,809,812 is manufactured substantially from conventional tubes and/or baffles disposed in a tubular outer shell. A single inlet tube of the muffler shown in U.S. Pat. No. 4,809,812 is divided into two substantially identical and symmetrical flow tubes which are then directed back toward one another from opposed directions. The recombined flow tubes may then lead to a second pair of divided then recombined flow tubes or to a chamber. The theory of U.S. Pat. No. 4,809,812 is that the direction of the initially divided flows against one another will attenuate noise. In practice, however, the muffler of U.S. Pat. No. 4,809,812 has not performed well accoustically.

Mufflers with Venturi tubes have been experimented with in the past. A Venturi tube defines a tubular section with a localized restriction. By carefully selecting the cross-sectional area of the Venturi tube restriction with respect to the upstream and down-stream tube cross-sections and by carefully selecting the location of the Venturi and the shape of the tapers leading into and out of the Venturi it is believed that positive effects on back pressure and noise attenuation can be achieved. Venturi tubes have been difficult and costly to incorporate into the conventional prior art muffler as shown in FIG. 1. Furthermore, it has been difficult to design Venturi tubes in mufflers that will achieve the theoretical benefits.

In view of the above, it is an object of the subject invention to provide a muffler that enables substantial improvements in engine performance.

It is another object of the subject invention to provide a muffler that efficiently attenuates noise.

A further object of the subject invention is to provide a muffler having a low profile.

Still an additional object of the subject invention is to provide a muffler that utilizes less metal material.

Yet a further object of the subject invention is to provide a stamp formed muffler that avoids deep draws of metal material during the formation of the muffler.

SUMMARY OF THE INVENTION

The muffler of the subject invention comprises at least one pair of plates that are disposed in face-to-face relationship with one another. The plates in each such pair are formed to define a plurality of tubes therebetween. The tubes are defined by channels in at least one of the plates such that a channel in one plate and the portion of the plate adjacent thereto define a tube through which exhaust gas may travel. In most embodiments a pair of substantially symmetrical channels in the respective plates will be disposed in opposed relationship to one another to define a tube. However, some tubes may be defined by a channel in one plate and a substantially planar portion of the other plate.

The tubes of the muffler comprise at least one inlet to the muffler and at least one outlet from the muffler. More particularly, the inlet to the muffler will be disposed and dimensioned to connect with the exhaust pipe leading into the muffler. The outlet from the muffler will similarly be disposed and dimensioned to connect to a tail pipe leading from the muffler.

The tubes of the muffler further comprise at least one array of unidirectional flow tubes. In this context, the term "unidirectional" is intended to mean that the tubes carry exhaust gas in generally the same direction from a first area of the muffler (e.g., an upstream chamber) to a second area of the muffler (e.g., a downstream chamber). The unidirectional flow tubes need not be parallel, and in a preferred embodiment described below the unidirectional flow tubes diverge as they extend from an upstream location to a downstream chamber. Each such array of unidirectional tubes may function to carry substantially all of the exhaust gas flowing from the inlet of the muffler to the outlet. However, each tube in such an array of unidirectional tubes will carry only a fraction of the exhaust gas flowing through the muffler, with the particular fraction being dependent upon the number of unidirectional tubes in the array, the cross-sectional dimensions of the respective unidirectional tubes in the array and the other flow control means that may exist in the muffler.

Each tube in the array of unidirectional tubes may define a cross-sectional area that is less than the cross-sectional area of the inlet tube. The sum of the cross-sectional areas of the tubes in the array of unidirectional tubes may be less than the cross-sectional area of the inlet, approximately equal to the cross-sectional area of the inlet or greater than the cross-sectional area of the inlet, depending upon the particular design of the muffler and on the tuning and back pressure requirements. In most embodiments, however, the sum of the cross-sectional areas of the tubes in an array of such unidirectional tubes will be selected to avoid an increase in back pressure in the muffler. On the other hand, the smaller cross-sectional dimensions of each such unidirectional tube may increase the speeds of exhaust gases flowing therethrough with corresponding tuning efficiencies. The tubes in each array of unidirectional tubes need not all have the same length and cross-sectional area. In the preferred embodiment, as explained below, the array of unidirectional tubes comprises two tubes. However more than two tubes in such an array may be provided.

The muffler further comprises an in-line expansion chamber downstream from the array of unidirectional tubes and with which each tube in an array of unidirectional tubes communicate. The tubes in the array of unidirectional tubes of the subject invention communicate with the in-line expansion chamber at spaced apart locations. This achieves vastly different accoustical effects from prior art mufflers that separate and then recombine flows of exhaust gas at locations upstream from an expansion chamber. The forming of the plates of the subject muffler preferably is carried out to provide smoothly curved surfaces at the interface of the unidirectional flow tubes and the in-line expansion chamber. This construction avoids the turbulence and eddying that had existed in prior art mufflers as explained above. More particularly, exhaust gases flowing from each of the tubes in an array of unidirectional tubes expands into the downstream in-line expansion chamber, with the expansion contributing to the attenuation of noise associated with the flow of exhaust gas. The cross-sectional area of the downstream in-line expansion chamber preferably is large compared to the cross-sectional area of any tube in the array of unidirectional tubes. In some embodiments, the cross-sectional area of the downstream in-line expansion chamber may approach or exceed twelve times the cross-sectional area of any tube in the array of unidirectional tubes communicating with the in-line expansion chamber.

The downstream in-line expansion chamber to which the unidirectional tubes extend further communicates with the outlet of the muffler. More particularly, a formed tube of the muffler may extend directly from the in-line expansion chamber to the outlet of the muffler. However, in some embodiments a second array of unidirectional tubes may communicate with the in-line expansion chamber and may extend therefrom to a second downstream in-line expansion chamber, which in turn may communicate with the outlet from the muffler. The provision of plural arrays of unidirectional tubes and plural in-line expansion chambers downstream from the respective arrays of tubes ca further contribute to the attenuation of noise of the muffler. In all such embodiments the interface between the in-line expansion chamber and the tubes preferably is defined by smoothly curved surfaces to minimize eddying and back pressure.

The muffler may further include an upstream in-line expansion chamber disposed intermediate the inlet to the muffler and the array of unidirectional tubes. The upstream in-line expansion chamber may permit the exhaust gas to initially expand after entering the muffler and to then flow into the respective tubes in the array of unidirectional tubes. Additionally, more than two in-line expansion chambers may be provided with one or more tubes extending from one in-line expansion chamber to the next. In all embodiments having plural in-line expansion chambers, the relative dimensions of each chamber and the dimension of tubes therebetween affect tuning performance. Algorithms for predicting performance in mufflers having only one conventional tube extending between two in-line expansion chambers of a conventional muffler are shown in the above referenced NACA Report 1192.

The in-line expansion chambers of the muffler of the subject invention may be formed in the plates which define the tubes of the muffler. Thus, the in-line expansion chambers and the tubes enable significant attenuation of noise with only two plates of the muffler. Additional attenuation can be achieved, if necessary, by an off-line chamber defined by at least one formed external shell of the muffler.

Selected portions of the plates in the muffler may be provided with communication means to permit expansion of exhaust gas into the off-line chamber surrounding the plates. The communication means may define cut-outs formed in the plates. Alternatively, the communication means may define arrays of perforations, louvers or slits which enable exhaust gas to expand into the surrounding off-line chamber. The off-line chamber may function as an expansion chamber or a side branch resonator depending upon the location and configuration of the communication means.

In most embodiments it will be desirable to securely affix the plates together at a plurality of locations to prevent the plates from vibrating and creating noise. The plates may be secured to one another at a plurality of discrete locations by, for example, welding. In particular, it may be desirable to weld the plates to one another between adjacent tubes to prevent vibration to enhance the strength of the tubes and to minimize the bleeding of exhaust gas between adjacent tubes. However, it also may be desirable to maximize the number of tubes that can be disposed in a small space. The attachment between tubes requires space, and it may be difficult to effect the attachment between closely spaced tubes. The attachment can be facilitated by forming the tubes to include a restriction in cross-sectional area at a selected point along the length of a tube. The restriction may be configured to function as a Venturi. The effects of Venturi restrictions on gas flowing through tubes is well documented. Consequently, the effect of the Venturi restriction on gas flow can be predicted with considerable accuracy. Furthermore, in some instances, the Venturi restriction may be configured and disposed to contribute to noise attenuation, even though for most applications the Venturi restriction merely provides an efficient means to provide an area for a weldment between tubes.

The muffler of the subject invention may further comprise at least one tuning tube having a length and cross-sectional area selected to attenuate a fairly narrow range of noise that may not adequately be attenuated by the above described combination of unidirectional tube arrays, in-line expansion chambers, communication means and off-line expansion chambers. The tuning tube may define a quarter-wave tuner in which a closed end tube communicates with a flow tube and has a length generally corresponding to one-quarter the wave length of the objectionable noise. In other embodiments, the tuning tube may communicate with a low frequency resonating chamber which may be formed between the plates defining the tubes of the muffler or which may be defined at least in part by an external shell of the muffler.

The muffler of the subject invention can achieve several very significant advantages. First, the muffler achieves the manufacturing efficiencies provided by stamp forming processes. The muffler can be manufactured to fit in any available space on the underside of the vehicle and can achieve an efficient alignment of pipes leading to and extending from the muffler. These advantages, however, also are available with the above-defined prior art stamped mufflers that are assigned to the Assignee of the subject invention. In addition to these known advantages, the stamped muffler of the subject invention can provide substantially minimal flow restrictions, thereby enhancing engine performance. The reduced flow restrictions are achievable in part by the above described plurality of unidirectional flow tubes. The muffler does not necessarily require the reversal of directions for the flowing exhaust gas which typically is employed in prior art mufflers. High performance can be achieved while still providing superior noise attenuation. The desirable noise attenuation characteristics are achievable in part because of the plurality of small unidirectional flow tubes each of which communicates at spaced apart locations with a comparatively large downstream in-line expansion chamber. Thus very high expansion ratios can be achieved when necessary. The muffler of the subject invention achieves its very desirable performance without requiring a complex configuration that may be difficult to form with some metals. In particular, the muffler may be substantially devoid of deep complex draws, such as the draws required by baffle creases. The fairly simple shape will further reduce the amount of metal required for the muffler, thereby lowering cost and weight. Furthermore the avoidance of baffles and the provision of small diameter tubes enables relatively large volume off-line chambers which in many circumstances achieves very good noise attenuation.

DETAILED DESCRIPTION OF THE PREFERRED EMBODIMENTS

Figure 2:
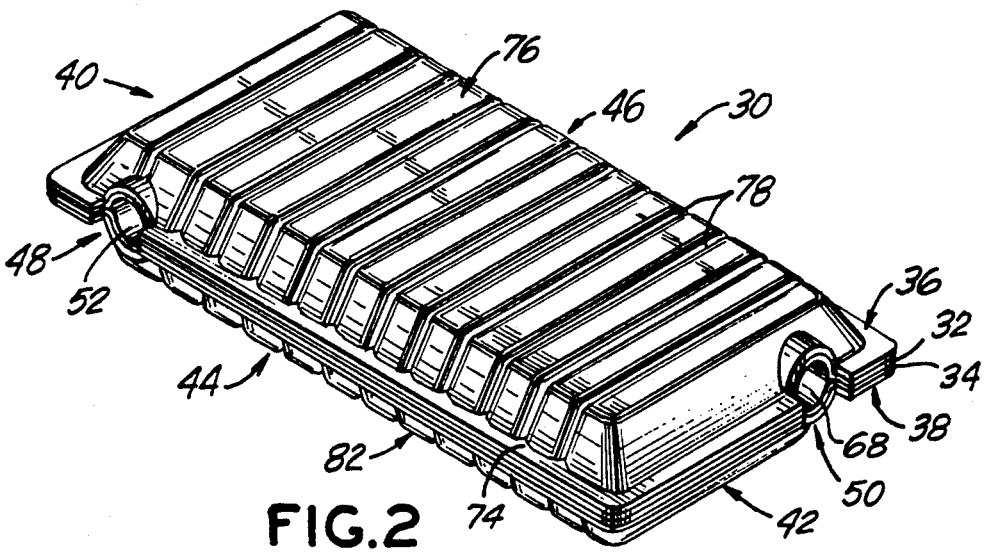
FIG. 2 is a perspective view of a first embodiment of a muffler in accordance with the subject invention.
Figure 3:
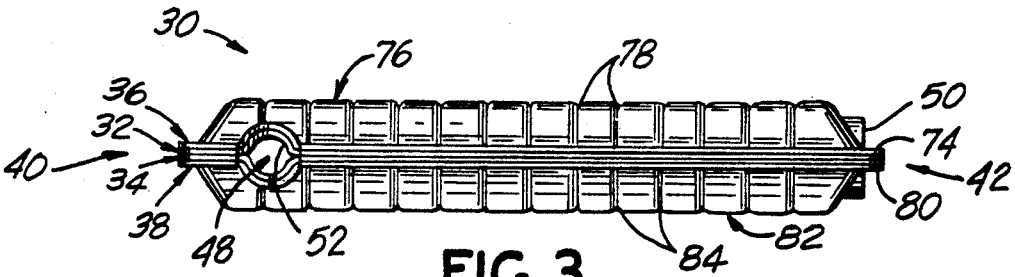
FIG. 3 is a side elevational view of the muffler shown in FIG. 2.

A first embodiment of a muffler in accordance with the subject invention is identified generally by the numeral 30 in FIGS. 2–3. The muffler 30 comprises first and second internal plates 3 and 34 that are secured generally in abutting face-to-face relationship with one another and first and second external shells 36 and 38 that are disposed around and substantially enclosing the plates 32 and 34. The muffler 30 is of generally rectangular configuration and includes opposed first and second longitudinal ends 40 and 42 and first and second opposed sides 44 and 46. However, the muffler may be of any non-rectangular configuration selected in accordance with the available space envelope on a vehicle. In this regard, the muffler of the subject invention may be designed in accordance with the above referenced U.S. Pat. No. 4,821,840 which is of a selected non-rectangular configuration to be nested in a correspondingly configured space envelope on a vehicle.

The muffler 30 includes an inlet 48 extending into the first side 44 of the muffler. The inlet 48 will be connected to the exhaust pipe leading from the engine and emission control equipment on the vehicle. The muffler further includes an outlet 50 extending from the second end 42 thereof. The outlet 50 will be connected to a tail pipe on the vehicle which will extend to a location for conveniently and safely releasing the exhaust gas. The location of the inlet 48 and outlet 50 will be determined substantially by the available space on the underside of the vehicle and the optional routing of the exhaust pipe and tail pipe. It will be appreciated that a more direct and less restrictive flow of exhaust gas can be achieved if the space on the underside of the vehicle permits the inlet 48 and outlet 50 to be at the opposed ends 40 and 42 of the muffler 30.

Figure 4:
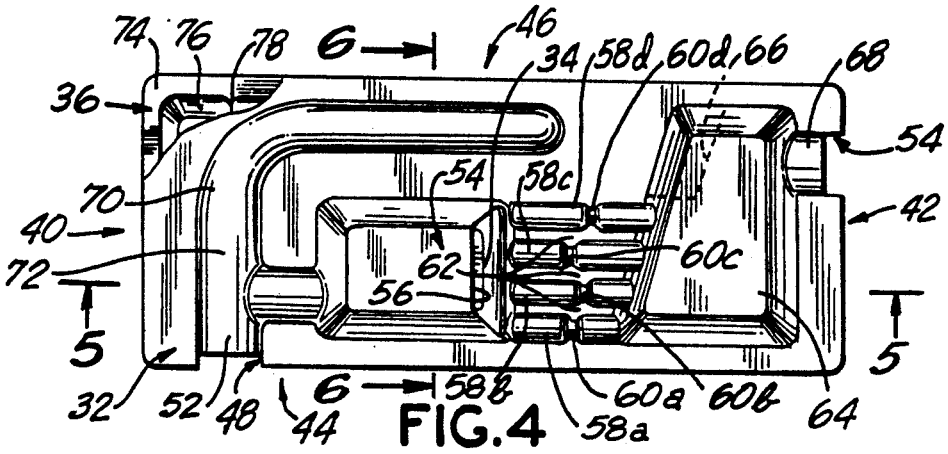
FIG. 4 is a top plan view, partly in section, of the muffler shown in FIGS. 2 and 3.
Figure 5:
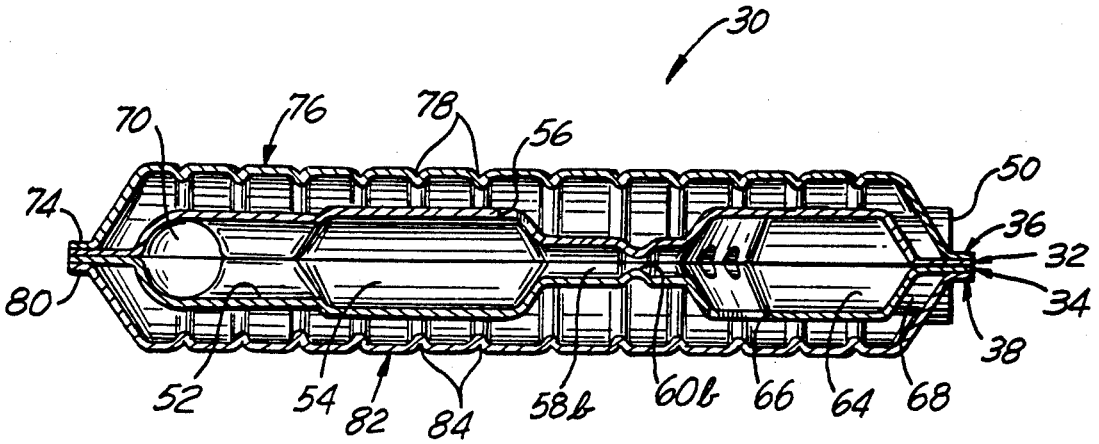
FIG. 5 is a cross-sectional view taken along lines 5—5 in FIG. 4.
Figure 6:
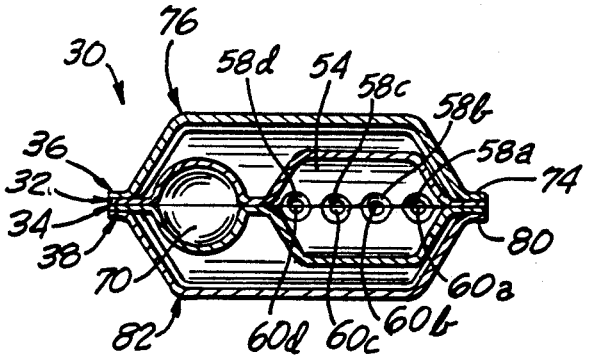
FIG. 6 is a cross-sectional view taken along lines 6—6 in FIG. 4.

As shown most clearly in FIGS. 4–6, the internal plates 32 and 34 of the muffler 30 are stamped or otherwise formed to define arrays of channels and a plurality of chambers therein. The channels are disposed substantially in register with one another to define tubes or passageways through which the exhaust gas from the engine will flow or otherwise communicate. Although the embodiment depicted herein shows channels in the first and second plates 32 and 34 being registered with one another, it is to be understood that such registration is not required. Some embodiments may include a channel in one plate disposed in register with a planar portion of the opposed plate. Thus, the resulting tube or passageway for exhaust gas may be of generally semi-circular cross-sectional configuration. Furthermore, the channels are not necessarily required to be of semi-circular cross-section. Other cross-sectional shapes may be employed. However, cross-sectional configurations that are free of sharp corners and edges generally are preferred, as explained further herein.

The channels and chambers formed in the first and second internal plates 32 and 34 define a inlet tube 52 extending from the inlet 48 to the muffler. The inlet tube 52 defines a cross-section substantially corresponding to the cross-section of the exhaust pipe (not shown) leading into the muffler 30. As a result, the inlet tube 52 will not create any significant back pressure on the muffler 30. The inlet tube 52 curves through a smooth arc and communicates with a first in-line expansion chamber 54 stamped into the internal plates 32 and 34. The portion of the first in-line expansion chamber 54 defined in the first internal plate 32 is characterized by an aperture 56 to permit expansion of exhaust gas into and off-line expansion chamber defined by the first external shell 36 as explained further below. Although the aperture 56 is depicted as a single rectangular cut-out, other configurations of communication means may be provided in accordance with the tuning requirements of the muffler 30. In particular, the aperture 56 may be replaced with an appropriate array of perforations, louvers, slots or one or more apertures of different dimensions in accordance with the tuning requirements for the muffler 30. The first in-line expansion chamber 54 defines a cross-sectional area which is substantially larger than the cross-sectional area of the inlet tube 52. The larger cross-sectional area of the first in-line expansion chamber 54 and the presence of the aperture 56 or other such communication means enables very substantial expansion of exhaust gas upon leaving the inlet tube 52, with a correspondingly efficient attenuation of noise.

The exhaust gas flowing through the muffler 30 proceeds from the first in-line expansion chamber 54 and through an array of unidirectional flow tubes **58*a–d*. Although the embodiment of the muffler 30 depicted herein includes a total of four unidirectional flow tubes 58*a–d*, embodiments with more or fewer flow tubes may be provided in accordance with the needs of the exhaust system. As will be explained further below very effective mufflers that appear to have broad application have two unidirectional flow tubes. Each flow tube 58*a–d* is of significantly smaller cross-sectional area than the cross-sectional area defined by the inlet tube 52. However, the combined cross-sectional area of all four unidirectional flow tubes 58*a–d* is selected to achieve a back pressure in a specified ratio to the back pressure existing upstream in the exhaust system, such as at the inlet tube 52. The particular ratio between the back pressure defined by the inlet tube 52 and by the array of unidirectional flow tubes 58*a–d* may vary from one exhaust system to the next depending, at least in part, upon the tuning requirements for the exhaust system and the engine performance requirements. In many situations, it may be desirable to have the pressure drop created by the array of unidirectional flow tubes 58*a–d* substantially equal the pressure drop that would be achieved by a single tube of uniform cross-section. However, in other situations, it may be desirable to increase the pressure drop across the unidirectional flow tubes 58***a–d* or to decrease the pressure drop.

Figure 7:
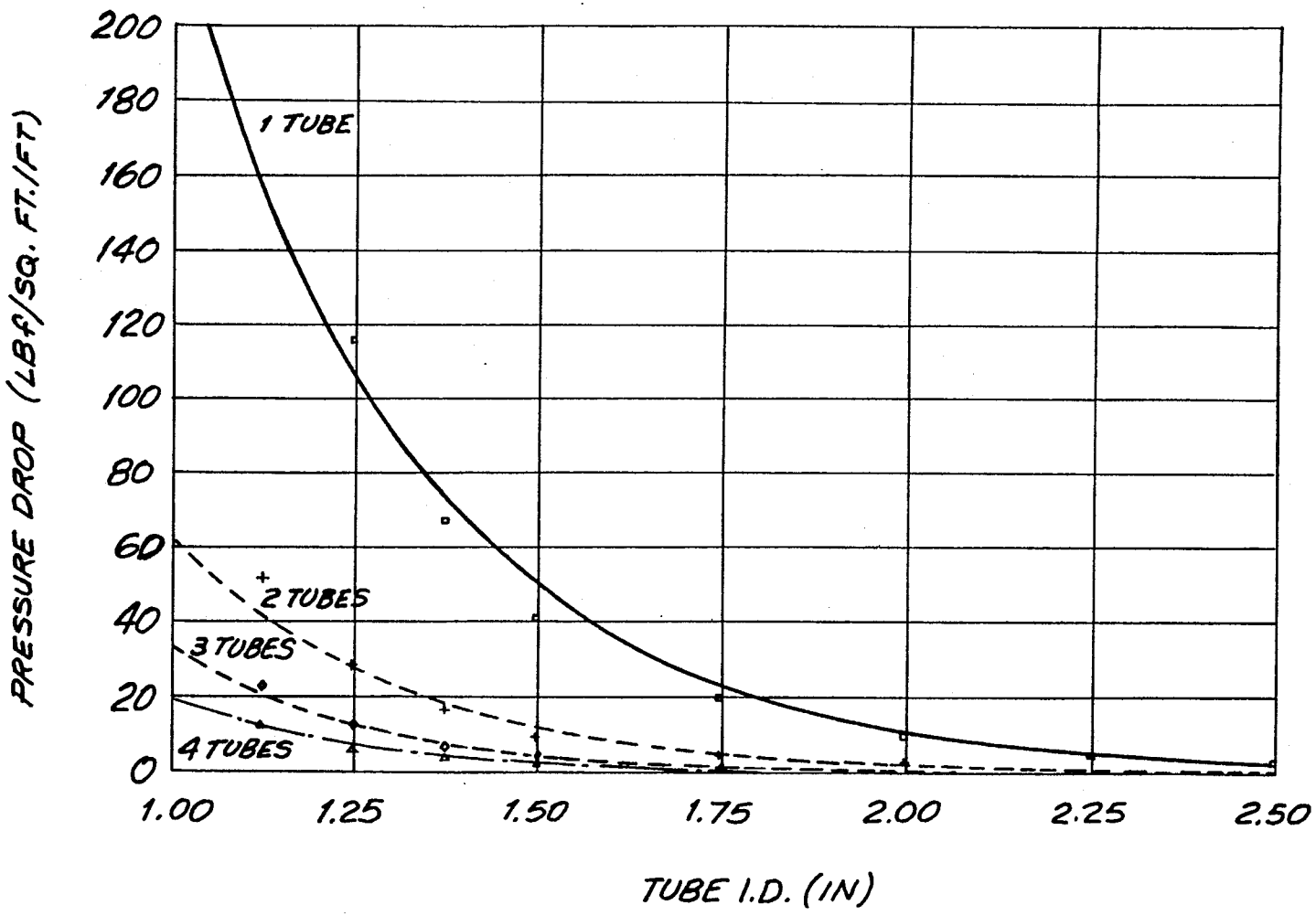
FIG. 7 is a graph showing parameters for designing the muffler to achieve specified back pressure levels.

The relationship between the number of tubes in the array of tubes 58*a–d* and the inside diameter of each individual tube is illustrated graphically in FIG. 7. For example, as shown in FIG. 7, a single inlet tube of 2.25 inch inside diameter could be used in combination with a total of four unidirectional flow tubes having internal diameters of slightly more than 1.25 inch without increasing the pressure drop of gas flowing into the smaller unidirectional tubes. However, it is not necessary for the unidirectional flow tubes 58*a–d* to all be of the same cross-sectional area, and the respective cross-sectional areas can be different from one another to achieve a specified acoustical tuning performance.

Returning to FIG. 4, it will be noted that the tubes 58*a–d* are provided with Venturi restrictions 60*a–d* respectively. The Venturi restrictions 60*a–d* may be employed to tailor the acoustical performance and engine performance across a family of similar or related mufflers. In particular, by including, removing or altering the dimensions of the Venturi restrictions 60*a–d* the effective inside diameter of the unidirectional flow tubes 58*a–d* can be altered, with corresponding effects on pressure drop and acoustical performance. Additionally, there will be many situations where it will be desired to maximize the number of unidirectional flow tubes within a specified area of the muffler 30. The small spaces existing between adjacent Venturi restrictions 60*a–d* provides a convenient area for disposing attachment means such as the welds 62 depicted in FIG. 4. Thus, the Venturi restrictions 60*a–d* enable the unidirectional flow tubes 58*a–d* to be disposed substantially adjacent to one another while still providing for fixed rigid attachment of the plates 32 and 34 at locations intermediate adjacent tubes 58*a–d*.

It will be noted that the Venturi restrictions 60*a–d* depicted in FIG. 4 are at different longitudinal positions along the associated unidirectional flow tubes 58*a–d*. These differential locations may not normally be necessary in situations where the Venturi is only provided to define a restriction and/or to provide room for a weld or other such attachment means 62. However, Venturi restrictions are known to affect tuning, and to significantly enhance tuning in certain situations. The effect of a Venturi restriction on acoustical tuning is difficult to predict, but is known to depend at least in part on the relative longitudinal positioning of the Venturi restriction along a flow tube. The illustrated differential longitudinal positioning of the Venturi restrictions 60*a–d* is intended to signify that the Venturi restrictions 60*a–d* may be longitudinally located to achieve a particular desired tuning effect. However, the longitudinal positions of the Venturi restrictions 60*a–d* depicted in FIG. 4 are for illustrative purposes only, and are not intended to imply an optimum pattern of Venturi restrictions for improved tuning in the muffler 30.

The unidirectional flow tubes 58*a–d* communicate at spaced apart locations with a second in-line expansion chamber 64. As depicted most clearly in FIG. 5, the intersection of each unidirectional flow tube 58*a–d* with the second in-line expansion chamber 64 is defined by outwardly flared arcuate surfaces that blend smoothly into the walls of the second in-line expansion chamber 64. This smooth transition between the unidirectional flow tubes 58*a–d* and the second in-line expansion chamber 64 conveniently can be achieved by appropriately configuring the dies from which the internal plates 32 and 34 are formed. These smooth transitions significantly enhance the acoustical performance of the muffler in a manner that generally cannot be achieved by conventional mufflers where tubes inherently terminate abruptly. The second in-line expansion chamber 64 defines a cross-sectional area substantially larger than the cross-sectional area of any one of the unidirectional flow tubes 58*a–d*. In particular, it is preferred that the cross-sectional area defined by the second in-line expansion chamber 64 is at least approximately twelve times the cross-sectional area of any one of the unidirectional flow tubes 58*a–d*. This large ratio enables very efficient expansion of exhaust gas flowing through the tubes 58*a–d* with a corresponding significant effect on noise attenuation. The amount of noise attenuation at any selected frequency also is partly determined by the length of the respective unidirectional flow tubes 58*a–d* between the in-line expansion chambers 54 and 64. As shown in FIG. 4, the plates 32 and 34 are formed to define different lengths for the tubes 58*a–d*, with the specific lengths being selected in accordance with the tuning requirements. In some embodiments the unidirectional flow tubes 58*a–d* may all be the same length.

The portion of the second in-line expansion chamber 6 defined by the second internal plate 34 is characterized by an aperture 66 stamp formed therein. The aperture 66 is provided to enable a controlled expansion of exhaust gas from the second in-line expansion chamber 66 into the chamber defined by the second external shell 38, as explained further below. The dimensions of the aperture 66 are selected in accordance with the exhaust gas flow characteristics and the required tuning. It will be understood the apertures having shapes different from aperture 66 depicted herein will be employed. Furthermore, communication means other than a single large aperture may also be employed, such as an array of perforations, louvers, slits or the like.

The muffler 30 further includes an outlet tube 68 which extends from the second in-line expansion chamber 64 to the outlet 50 of the muffler 30. The outlet tube 68 has a cross-sectional size selected to minimize back pressure and to thereby minimize any effect on engine performance. The outlet tube 68 will be connected to the tail pipe (not shown) of the exhaust system which will extend to a convenient location on a vehicle for release of the exhaust gases.

The muffler 30 is further characterized by a tuning tube 70 which communicates with the inlet tube 52. The tuning tube 70, as depicted most clearly in FIG. 4, is an elongated closed-end tube having a length and cross-sectional dimension selected in accordance with a particular fairly narrow range of noise that may not be adequately attenuated by the portions of the exhaust system described above. Some embodiments of the muffler 30 may not require a tuning tube 70. Other embodiments of the muffler 30 may require a tuning tube having a length and/or cross-section that differs from the tuning tube depicted herein. Still other embodiments of the muffler 30 may include a tuning tube 70 that communicates with a low frequency resonating chamber defined by one of the external shells 36 or 38. In particular, a portion of the tuning tube 70 defined by one of the internal plates 32 or 34 may define an aperture which permits communication with a chamber defined by an external shell 36 or 38. It will be noted that the entrance portion 72 of the tuning tube 70 is substantially colinearly aligned with a portion of the inlet tube 52. This colinear alignment is helpful for achieving a "driven"

tuning, which in many instances is more effective than a tuning tube aligned at an angle to an associated flow tube.

The first external shell 36 is stamped to define a generally planar peripheral flange 74 which is configured and dimensioned to be placed in register with peripheral regions of the first internal plate 32. The first external shell 36 is further formed to define an off-line chamber 76 extending from the plane of the peripheral flange 74. The off-line chamber 76 may function as an expansion chamber or a branch resonator depending upon the type of communication means defined by the internal plate 32. As depicted herein, the off-line chamber 76 is a generic rectangular shape. However, off-line chambers may be provided with a size and shape that generally conforms to the available space on the underside of a vehicle, and to define a volume that meets the acoustical requirements of the exhaust system. It will be noted that the off-line chamber 76 is characterized by an array of generally parallel grooves 78 for reinforcing the off-line chamber 76 and preventing vibration and associated shell ring. The reinforcing grooves 78 may be configured as disclosed in U.S. Pat. No. 4,924,968 which issued to Moring et al. on May 15, 1990 and which is assigned to the Assignee of the subject invention.

It will be noted that the first external shell 36 includes only one chamber extending from the peripheral flange 74. In particular, the first external shell 36 is substantially free of creases extending entirely thereacross and connecting to spaced apart locations on the peripheral flange 74. This construction minimizes the amount of draw or deformation required of the metal from which the first external shell 36 is formed, thereby achieving certain weight and cost advantages. This construction further enables a larger off-line chamber than could otherwise be provided. In addition to the material savings achievable by avoiding a crease, the off-line chamber 76 defined in the first external shell 36 can be formed to define a low profile which requires less drawing of metal material. The lower profile is at least partly attributable to the small cross-section in the unidirectional flow pipes 58*a–d*. Furthermore, the illustrated combination of in-line expansion chambers 54 and 64 with flow tubes, including the unidirectional flow tubes 58*a–d* achieves superior noise attenuation that often will reduce the relative noise attenuation functions being carried out by the off-line chamber 76. Thus, in these situations, a comparatively small volume may be required for the off-line chamber 76, thereby avoiding the need for a deeply drawn first external shell 36, and hence reducing the amount of metal required.

The second external shell 38 is depicted as being substantially identical to the first external shell 36. More particularly, the second external shell 38 includes a peripheral flange 80 which is configured and dimensioned to be placed substantially in register with the peripheral regions of the second internal plate 34. The second external shell 38 is further formed to define an off-line chamber 82 extending from the plane defined by the peripheral flange 80. The off-line chamber 82 is characterized by reinforcing grooves 84 substantially identical to the reinforcing grooves 78 in the first external shell 36. It is to be understood, however, that the second external shell 38 and the off-line chamber 82 formed therein need not be a mirror image of the first external shell 36. The size and configuration of the off-line chamber 8 formed in the second external shell 38 will be selected in accordance with tuning requirements of the vehicle and the size and shape of available space on the vehicle.

The muffler 30 is assembled by initially securing the first and second internal plates 32 and 34 in face-to-face relationship. This initial attachment may be achieved by disposing a plurality of spot welds or other mechanical means at selected planar locations in proximity to the tubes and the in-line expansion chambers formed therein. The peripheral flanges 74 and 80 of the external shells 36 and 38 respectively are then securely affixed to the first and second internal plates 32 and 3 at peripheral regions thereof. This attachment may be by welding or by mechanical attachment means which may include a mechanical crimping of the flanges together. Attachments of the external shells 36 and 38 to the plates 32 and 34 at locations intermediate the flanges 74 and 80 may be provided by, for example, plunge welds. The assembled muffler 30 may then be appropriately connected to an exhaust pipe at the inlet 48 thereof and to a tailpipe at the outlet 50 thereof. With this construction, exhaust gas will enter the inlet tube 52 and will travel into the first in-line expansion chamber 54 at which an efficient expansion of exhaust gas will occur. In addition to the expansion occurring as a result of the first in-line expansion chamber 54, additional expansion will occur through the aperture 56. Thus, the exhaust gas will be permitted to expand or otherwise communicate through the aperture 56 and into the first off-line chamber 7 which is defined by the first external shell 36. Exhaust gas will continue to flow from the first in-line expansion chamber 54 and into the unidirectional flow tubes 58*a–d*. The cross-sectional areas of the flow tubes 58*a–d* may be defined by Venturi restrictions 60*a–d*. The effective cross-sectional area preferably is selected to achieve a back pressure that conforms to the back pressure created at the inlet tube 52, and without creating any significant additional pressure drop. Exhaust gas will proceed through the muffler 30 from the unidirectional flow tubes 58*a–d* and into the second in-line expansion chamber 64. The cross-sectional area defined at the second in-line expansion chamber 64 preferably is at least approximately twelve times the cross-sectional area of any one of the unidirectional flow tubes 58*a–d*. These relative dimensions will enable a significant second expansion of exhaust gas with corresponding noise attenuation. Still further attenuation can be achieved by the cut-out 66 in the second in-line expansion chamber 64 which will enable the exhaust gas to expand or otherwise communicate into the second off-line chamber 82 which is defined in the second external shell 38. The exhaust gas will continue to flow from the second in-line expansion chamber 64 through the outlet tube 68 and into the tail pipe of the exhaust system. The tuning tube 70 is provided in the muffler to attenuate a fairly narrow range of low frequency noise that may not be adequately attenuated by the in-line expansion chambers 54, 64 and the off-line chambers 76, 82.

Figure 8:
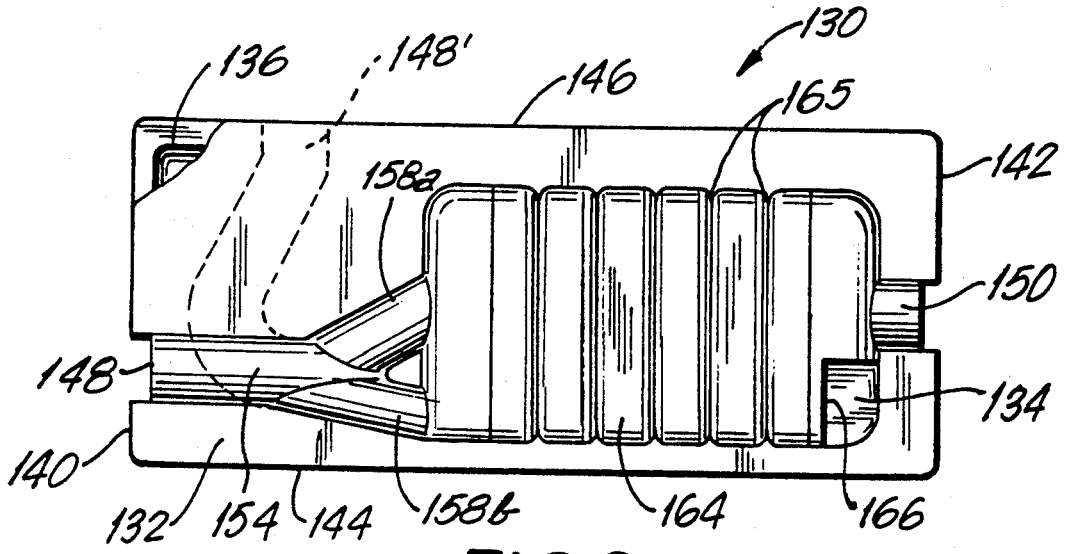
FIG. 8 is a top plan view, partly in section, of a second embodiment of a muffler in accordance with the subject invention.

An alternate muffler embodiment is depicted in FIG. 8 and is identified generally by the number 130. The external shell 136 of the muffler 130 is broken away to show the tubes and chambers of the muffler. It is to be understood, however, that the external shell 136 is configured similarly to the external shell 36 of the muffler 30 as depicted in FIGS. 2 and 3 above. It is also to be understood that a lower external shell similar to the external shell 38 in FIGS. 2 and 3 may also be provided. In some embodiments, however, the external shell 136 may not be required and the muffler 130 may consist only of the plates in which the tubes and chambers depicted in FIG. 8 are formed.

With further reference to FIG. 8, it will be noted that the muffler 130 includes first and second plates 132 and 134 that are of generally rectangular configuration with opposed first and second longitudinal ends 140 and 142 and opposed first and second sides 144 and 146. Other mufflers incorporating the features of the subject invention may be of various nonrectangular configurations. It will be appreciated that the plates 132 and 134 are formed to define a very direct flow path for exhaust gas with very low back pressure. In particular, the plates 132 and 134 are formed to define an inlet 148 at the first end 140 of the muffler and an outlet 150 at the opposed second end 142 of the muffler. The inlet 148 extends to a pair of unidirectional flow tubes 158*a* and 158*b* which extend to spaced apart locations at a downstream in-line expansion chamber 164. As noted with respect to the previously described embodiment, the length and cross-sectional dimensions of the unidirectional flow tubes 158*a* and 158*b* need not be identical. In this embodiment, the area 154 immediately upstream of the two unidirectional flow tubes 158*a* and 158*b* functions as a small in-line expansion chamber which permits exhaust gas to expand slightly for subsequent flow into the unidirectional flow tubes 158*a* and 158*b*. Although the unidirectional flow tubes 158*a* and 158*b* diverge from substantially intersecting locations, they do not reconverge toward one another. Rather the unidirectional flow tubes 158*a* and 158*b* communicate with the downstream in-line expansion chamber 164 at the spaced apart locations illustrated in FIG. 8.

The downstream in-line expansion chamber 164 is provided with a aperture 166 at the portion thereof generally adjacent the second end 142 of the muffler 130. The aperture 166 permits communication with the chamber defined by the external shell 136. A similar aperture may be provided in the lower plate 134 to communicate with a second external shell (not shown). The provision of the aperture 166 communicating with a substantially enclosed chamber of the external shell 136 creates a Helmholtz resonating chamber. This Helmholtz chamber defined by the external shell 136 is structurally different from the low frequency resonating chambers described in some of the above referenced prior art in that the muffler 130 does not include a discrete tuning tube extending into the Helmholtz chamber. However, the exceptional attenuation achieved by the plates 132 and 134 enables substantially all of the external shell 136 to be devoted to the Helmholtz chamber. Larger Helmholtz chambers are generally more effective in attenuating lower frequency noise, thereby enabling the illustrated Helmholtz chamber to be very effective despite the absence of an elongated tuning tube. The effectiveness of the Helmholtz chamber is further optimized by the relative location of the aperture 166. More particularly, as illustrated in FIG. 8, the aperture 166 is disposed generally opposite the flow of the exhaust gas entering the chamber 164, and hence the Helmholtz chamber defined by the external plate 136 is "driven" with significant functional advantages. With this general location of the aperture 166 and with the relative ease of design changes afforded by stamped technology, it is possible to select a configuration for the aperture 166 to achieve the needed tuning characteristics. It will also be noted that the downstream in-line expansion chamber 164 is characterized by an array of parallel reinforcing grooves 165 which are structurally and functionally similar to reinforcing grooves 78 and 84 on external shell 36 of the muffler 30 depicted in FIG. 2. The downstream in-line expansion chamber 164 communicates with the outlet tube 150 at the end thereof substantially opposite the unidirectional flow tubes 158*a* and 158*b*.

It will be appreciated that the muffler 130 provides an extremely direct flowpath and therefore low back pressure. However, this simple flow path has proved to be extremely effective in attenuating noise. With the illustrated design, the dimensions of the inlet tube 148, the small upstream in-line expansion chamber 154, the unidirectional flow tubes 158*a* and 158*b* and the downstream in-line expansion chamber 164 all can be varied selectively to tune the muffler 130 for achieving the necessary attenuation with low back pressure. In particular, the relative dimensions are selected to achieve the most effective expansion ratios for the particular exhaust system. The design of this and the preceding embodiment enable very high expansion ratios to be achieved, when necessary, without resorting to a very large muffler. In many situations the external shell 136 and the lower external shell (not shown) will not be needed for acoustical purposes and therefore may be eliminated entirely. In some other situations, the external shell 136 may be incorporated to perform only a heat insulation function, without performing any noise attenuation function. It will further be understood, that in many embodiments the inlet and outlet 148 and 150 cannot conveniently be disposed at the opposed ends 140 and 142. In these situations, a side inlet 148' may be provided with a long sweeping stamp formed turn that does not significantly affect back pressure.

Figure 1:
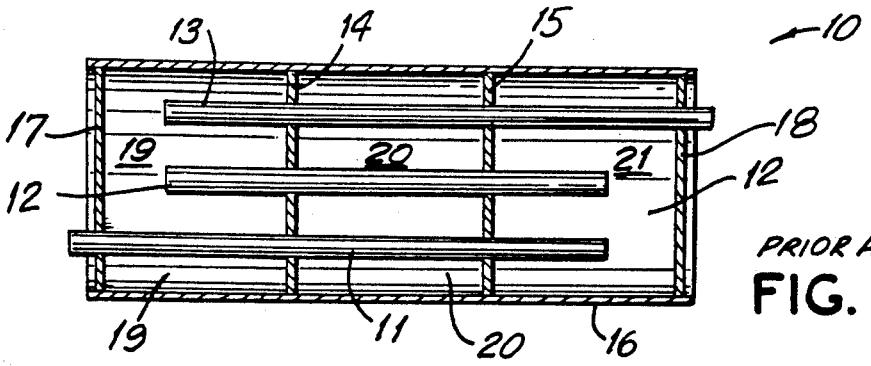
PRIOR ART FIG. 1
FIG. 1 is a longitudinal cross-sectional view of a prior art muffler.
Figure 9:
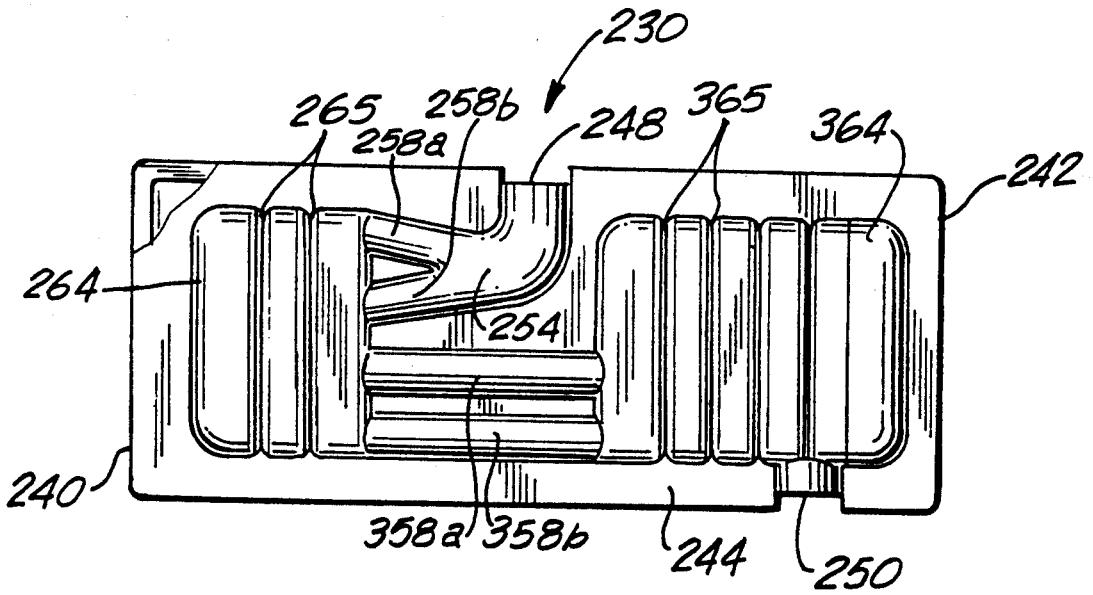
FIG. 9 is a top plan view, partly in section, of a third embodiment of a muffler in accordance with the subject invention.

Still a further embodiment is illustrated in FIG. 9 and is identified by the numeral 230. The rectangular muffler 230 depicted in FIG. 9 includes opposed first and second ends 240 and 242 and opposed first and second sides 244 and 246. In this embodiment, the inlet 248 extends into the second side 246 while the outlet 250 extends from the first side 244. It will be noted that the exhaust flow path depicted herein is slightly more circuitous than in the previously described embodiments, but is substantially less circuitous than the typical prior art muffler as depicted in FIG. 1. The muffler 230 depicted in FIG. 9 is similar to the previous embodiments in that it includes unidirectional flow tubes communicating with in-line expansion chambers. The muffler 230 differs from the previous embodiments, however, in that it includes first and second pairs of unidirectional flow tubes. In particular, the muffler 230 includes a small first in-line expansion chamber 254 communicating with and directly downstream from the inlet 248. A first array of unidirectional flow tubes comprising tubes 258*a* and 258*b* diverge from the first in-line expansion chamber 254 and communicate with a second in-line expansion chamber 264 at spaced apart locations therein. A second array of unidirectional flow tubes 358*a* and 358*b* extend from the second in-line expansion chamber 264 to a third in-line expansion chamber 364 which in turn communicates with the outlet 250. As in the previous embodiments, the relative dimensions of the in-line expansion chambers 254, 264 and 364 and the relative dimensions of the unidirectional flow tubes 258*a*, 258*b*, 358*a* and 358*b* are selected to achieve the most desirable expansion ratios and noise attenuation for the particular exhaust system. As in the previous embodiment, the larger in-line expansion chambers 264 and 364 are provided with reinforcing grooves 265 and 365 respectively. Additionally, as in the preceding embodiments, the in-line expansion chambers 254, 264 and 364 can be provided with means for communicating with an external shell of the muffler 230.

While the invention has been described with respect to a preferred embodiment, it is apparent that various changes can be made without departing from the scope of the invention as defined by the appended claims. For example, the muffler may be manufactured with only the first and second formed plates or with the formed plates and only one of the two only external shells. In these embodiments, of course, at least one of the formed plates will not be provided with a communication aperture formed therein. In other embodiments a chamber defined by an external shell may function as a low frequency resonating chamber which communicates with the tuning tube. In still other embodiments, a tuning tube will not be necessary in view of an adequate attenuation of noise by the combination of in-line and off-line chambers. In still other variations, more or fewer unidirectional flow tubes may be provided, with the flow tubes being free of Venturi restrictions in some embodiments or with different patterns of Venturi restrictions than those depicted herein. In still other embodiments communication means other than the apertures depicted herein may be provided, such as arrays of perforations and/or louvers. These and other variations will be apparent to a person skilled in this art after having read the subject invention disclosure.

We claim:

1. An exhaust muffler comprising first and second plates secured in generally face-to-face relationship with one another and formed to define tubes therebetween, said tubes comprising an inlet to the muffler and an outlet from the muffler, said tubes further comprising at least one array of unidirectional flow tubes in communication with the inlet such that each of said flow tubes in said array receives a portion of the exhaust entering the inlet, each of said unidirectional flow tubes defining a cross-sectional area less than the cross-sectional area of the inlet of the muffler, said muffler further comprising at least one in-line expansion chamber defined between the plates and disposed intermediate the array of unidirectional flow tubes and the outlet of the muffler, such that each said unidirectional flow tube communicates directly to said in-line expansion chamber for permitting an expansion of exhaust gas from each of the unidirectional flow tubes into the in-line expansion chamber, the plates being formed such that each said unidirectional flow tube comprises outwardly flared arcuate surfaces that blend smoothly into portions of the plates defining the in-line expansion chamber.

2. A muffler as in claim 1 wherein the in-line expansion chamber defines a first in-line expansion chamber, and wherein said muffler further comprises a second in-line expansion chamber communicating with the array of unidirectional flow tubes and disposed intermediate the array of unidirectional flow tubes and the inlet of the muffler.

3. A muffler as in claim 1 wherein the combined cross-sectional area of the unidirectional flow tubes is approximately equal to the cross-sectional area of the inlet.

4. A muffler as in claim 1 wherein the combined cross-sectional area of the unidirectional flow tubes is less than the cross-sectional area of the inlet.

5. A muffler as in claim 1 wherein the combined cross-sectional area of the unidirectional flow tubes is greater than the cross-sectional area of the inlet.

6. A muffler as in claim 1 wherein at least one of said unidirectional flow tubes comprises a Venturi restriction therein, said Venturi restriction defining a minimum cross-sectional area of the associated unidirectional flow tube.

7. A muffler as in claim 1 wherein the tubes of the muffler further comprise at least one tuning tube.

8. A muffler as in claim 1 wherein at least two of the unidirectional flow tubes in said array are of different respective lengths.

9. An exhaust muffler comprising first and second plates secured in generally face-to-face relationship with one another and formed to define tubes therebetween, said tubes comprising an inlet to the muffler and an outlet from the muffler, said tubes further comprising at least one array of unidirectional flow tubes in communication with the inlet such that each of said flow tubes in said array receives a portion of the exhaust entering the inlet, said muffler further comprising at least one in-line expansion chamber defined between the plates and disposed intermediate the array of unidirectional flow tubes and the outlet of the muffler, such that each said unidirectional flow tube communicates directly to said in-line expansion chamber for permitting an expansion of exhaust gas from each of the unidirectional flow tubes into the in-line expansion chamber, the in-line expansion chamber defines a cross-sectional area approximately twelve times greater than the cross-sectional area defined by each of said unidirectional flow tubes, the plates being formed such that each said unidirectional flow tube comprises outwardly flared arcuate surfaces that blend smoothly into portions of the plates defining the in-line expansion chamber.

10. An exhaust muffler comprising first and second plates secured in generally fact-to-face relationship with one another and formed to define tubes therebetween, said tubes comprising an inlet to the muffler and an outlet from the muffler, said tubes further comprising at least one array of unidirectional flow tubes in communication with the inlet such that each of said flow tubes in said array receives a portion of the exhaust entering the inlet, said muffler further comprising at least one in-line expansion chamber defined between the plates and disposed intermediate the array of unidirectional flow tubes and the outlet of the muffler such that each said unidirectional flow tube communicates directly to said in-line expansion chamber for permitting an expansion of exhaust gas from each of the unidirectional flow tubes into the in-line expansion chamber, said muffler further comprising at least one external shell formed to define at least one off-line chamber, said external shell being secured to at least one of said plates such that the off-line chamber surrounds at least portions of the tubes and the in-line expansion chamber formed by said plates, said plates comprising communication means for permitting communication of the exhaust gas with the off-line chamber.

11. A muffler as in claim 10 wherein the communication means is defined by at least one aperture in the in-line expansion chamber.

12. An exhaust muffler comprising first and second plates secured in generally face-to-face relationship with one another and formed to define a plurality of tubes and at least first and second in-line expansion chambers between said plates, said tubes comprising an inlet tube defining an inlet to the muffler and extending to the first in-line expansion chamber, said tubes further comprising an array of unidirectional flow tubes, with each of said unidirectional flow tubes in said array extending from the first in-line expansion chamber to the second in-line expansion chamber and, an outlet tube communicating with the second in-line expansion chamber and defining an outlet from the muffler, each of said unidirectional flow tubes carrying a selected portion of exhaust gas flowing between the first and second in-line expansion chambers, the plates being formed such that each said unidirectional flow tube comprises outwardly flared arcuate surfaces that blend smoothly into portions of the plates defining the first and second in-line expansion chambers.

13. An exhaust muffler as in claim 12 further comprising a tuning tube communicating with a selected portion of the array of tubes and the in-line expansion chambers.

14. A muffler as in claim 12 wherein at least two of the unidirectional flow tubes are of different respective lengths.

15. A muffler as in claim 12 wherein the array of unidirectional flow tubes comprises two unidirectional flow tube.

16. A muffler as in claim 12 wherein said unidirectional flow tubes are aligned to the outlet for achieving a direct flow of exhaust gas and thereby maintaining a low pressure drop in the muffler.

17. An exhaust muffler comprising first and second plates secured in generally face-to-face relationship with one another and formed to define a plurality of tubes and at least first and second in-line expansion chambers between said plates, said tubes comprising an inlet tube defining an inlet to the muffler and extending to the first in-line expansion chamber, said tubes further comprising an array of unidirectional flow tubes, with each said flow tube in said array extending from the first in-line expansion chamber to the second in-line expansion chamber and defining an outlet from the muffler, each of said unidirectional flow tubes carrying a selected portion of exhaust gas flowing between the first and second in-line expansion chambers, said muffler further comprising a first external shell securely attached to the first plate and being formed to define a first off-line chamber surrounding selected portions of the tubes and the in-line expansion chambers, a portion of said first plate being provided with communication means extending therethrough for permitting communication with the first off-line chamber.

18. A muffler as in claim 17 further comprising a second external shell secured to said second plate and formed to define a second off-line chamber surrounding at least selected portions of the tubes and the in-line expansion chambers, a selected portion of the second plate being formed to include communication means for permitting communication with the second off-line chamber.

19. A muffler as in claim 17 wherein each of said unidirectional flow tubes is formed to define an outward flared portion adjacent the respective first and second in-line expansion chambers.

20. An exhaust muffler comprising first and second plates secured in generally face-to-face relationship with one another and formed to define a plurality of tubes and at least first and second in-line expansion chambers between said plates, said tubes comprising an inlet tube defining an inlet to the muffler and extending to the first in-line expansion chamber, said tubes further comprising an array of unidirectional flow tubes, with each said flow tube in said array extending from the first in-line expansion chamber to the second in-line expansion chamber and an outlet tube communicating with the second in-line expansion chamber and defining an outlet from the muffler, each of said unidirectional flow tubes carrying a selected portion of exhaust gas flowing between the first and second in-line expansion chambers, the plates being formed such that each said unidirectional flow tube comprises outwardly flared arcuate surfaces that blend smoothly into portions of the plates defining the first and second in-line expansion chambers, wherein each of said unidirectional flow tubes defines a cross-sectional area and wherein said second in-line expansion chamber defines a cross-sectional area, the cross-sectional area of the second in-line expansion chamber being at least 12 times greater than the cross-sectional area of at least one of said unidirectional flow tubes.

21. A muffler as in claim 20, wherein the inlet tube defines a cross-sectional area, the sum of the cross-sectional areas of the unidirectional flow tubes having a ratio to the cross-sectional area of the inlet tube to avoid an increase in pressure drop therebetween.

22. An exhaust muffler comprising first and second plates secured in generally face-to-face relationship with one another and formed to define a plurality of tubes and at least first and second in-line expansion chambers between said plates, said tubes comprising an inlet tube defining an inlet to the muffler and extending to the first in-line expansion chamber, said tubes further comprising an array of unidirectional flow tubes, with each said flow tube in said array extending from the first in-line expansion chamber to the second in-line expansion chamber and an outlet tube communicating with the second in-line expansion chamber and defining an outlet from the muffler, each of said unidirectional flow tubes carrying a selected portion of exhaust gas flowing between the first and second in-line expansion chambers, the plates being formed such that each said unidirectional flow tube comprises outwardly flared arcuate surfaces that blend smoothly into portions of the plates defining the first and second in-line expansion chambers, wherein at least one of said unidirectional flow tubes includes a Venturi restriction therein.

23. An exhaust muffler comprising first and second plates secured in generally face-to-face relationship with one another and formed to define a plurality of tubes and at least first and second in-line expansion chambers between said plates, said tubes comprising an inlet tube defining an inlet to the muffler and extending to the first in-line expansion chamber, said tubes further comprising an array of unidirectional flow tubes, said unidirectional flow tubes diverge from one another from a common location defining the first in-line expansion chamber and extend to spaced apart locations in the second in-line expansion chamber, and an outlet tube communicating with the second in-line expansion chamber and defining an outlet from the muffler, each of said unidirectional flow tubes carrying a selected portion of exhaust gas flowing between the first and second in-line expansion chambers.

24. An exhaust muffler comprising first and second plates secured in generally face-to-face relationship with one another and formed to define an inlet tube, an outlet tube, an in-line expansion chamber providing communication to said outlet tube and a pair of unidirectional flow tubes providing communication from said inlet tube to said in-line expansion chamber, with said unidirectional flow tubes intersecting said in-line expansion chamber at spaced apart locations, the first and second plates being formed such that each said unidirectional flow tube comprises outwardly flared arcuate surfaces that blend smoothly into portions of the first and second plates defining said in-line expansion chamber.

25. A muffler as in claim 24, wherein said in-line expansion chamber defines a downstream in-line expansion chamber, and wherein the unidirectional flow tubes communicate with the inlet tube at an area between the plates defining an upstream in-line expansion chamber.

26. An exhaust muffler comprising first and second plates secured in generally face-to-face relationship with one another and formed to define an inlet tube, an outlet tube, an upstream in-line expansion chamber in communication with the inlet tube, a downstream in-line expansion chamber providing communication to said outlet tube and a pair of unidirectional flow tubes providing communication between said upstream in-line expansion chamber and said downstream in-line expansion chamber, with said unidirectional flow tubes intersecting said downstream in-line expansion chamber at spaced apart locations, wherein said upstream in-line expansion chamber is smaller than said downstream in-line expansion chamber.

27. An exhaust muffler comprising first and second plates secured in generally face-to-face relationship with one another and formed to define an inlet tube, an outlet tube, an in-line expansion chamber providing communication to said outlet tube and a pair of unidirectional flow tubes providing communication from said inlet tube to said in-line expansion chamber, with said unidirectional flow tubes intersecting said in-line expansion chamber at spaced apart locations, said muffler further comprising a first external shell secured to said first plate and formed to define a chamber surrounding at least portions of said first plate, aperture means formed through said first plate for providing communication to the chamber defined by the first external shell.

28. A muffler as in claim 27 wherein the aperture means is formed through a portion of said in-line expansion chamber generally opposite the unidirectional flow tubes.

29. An exhaust muffler comprising first and second plates secured in generally face-to-face relationship with one another and formed to define a plurality of tubes and at least first, second and third in-line expansion chambers between said plates, said tubes comprising an inlet tube defining an inlet to the muffler and extending to the first in-line expansion chamber, said tubes further comprising a first array of unidirectional flow tubes with each said flow tube in said first array extending from the first in-line expansion chamber to the second in-line expansion chamber, a second array of unidirectional flow tubes, with each said flow tube in said second array extending from the second in-line expansion chamber to the third in-line expansion chamber and an outlet tube communicating with the third in-line expansion chamber and defining an outlet from the muffler, each of said unidirectional flow tubes in said first array carrying a selected portion of exhaust gas flowing between the first and second in-line expansion chambers, each of said unidirectional flow tubes in said second array carrying a selected portion of exhaust gas flowing between the second and third in-line expansion chambers, the plates being formed such that each said unidirectional flow tube comprises outwardly flared arcuate surfaces that blend smoothly into portions of the plates defining the in-line expansion chambers.

* * * * *